United States Patent [19]

Christensen

[11] 4,389,965

[45] Jun. 28, 1983

[54] TENSION WIRE METER FOR IMPREGNATING FOAM WITH LIQUID FABRIC CONDITIONER

[75] Inventor: Rolf E. Christensen, Wallingford, Pa.

[73] Assignee: Scott Paper Company, Philadelphia, Pa.

[21] Appl. No.: 881,245

[22] Filed: Feb. 27, 1978

Related U.S. Application Data

[62] Division of Ser. No. 788,778, Apr. 19, 1977, Pat. No. 4,109,035.

[51] Int. Cl.[3] ..... B05C 1/06; B05C 1/08; B05C 11/02

[52] U.S. Cl. ..... 118/261; 118/126; 118/249; 118/262

[58] Field of Search ..... 118/104, 126, 203, 249, 118/261, 262; 427/359, 361, 362, 363, 364, 365, 366, 356, 358

[56] References Cited

U.S. PATENT DOCUMENTS 3,895,128 7/1975 Gaiser ..... 428/339
4,180,317 12/1979 Schroter ..... 118/261 X

*Primary Examiner*—Michael R. Lusignan
*Attorney, Agent, or Firm*—Nicholas J. DeBenedictis; John W. Kane, Jr.

[57] ABSTRACT

Heat activated, fabric conditioning products are made by impregnating a thick, absorbent substrate with fabric-conditioner chemicals. Such products are designed for use at elevated temperatures encountered in laundry dryers. This invention provides an improved process for making such products and an apparatus for applying liquids to the substrate. Previously a doctor blade was used in combination with a roller to limit the volume of liquid being applied to the substrate during compression of the substrate in a nip. The present invention concerns a thin wire drawn under tension which can function as the doctor to obtain a smooth thin film of liquid on the lower roller of the nip used for applying the liquid to the substrate.

6 Claims, 2 Drawing Figures

TENSION WIRE METER FOR IMPREGNATING FOAM WITH LIQUID FABRIC CONDITIONER

This is a division of application Ser. No. 788,778 filed Apr. 19, 1977, now U.S. Pat. No. 4,109,035, patented Aug. 22, 1978.

BACKGROUND OF THE INVENTION

1. Field of the Invention

This invention relates to a tension wire doctor device and to fabric-softening products suitable for use at elevated temperatures and made by impregnating liquid fabric softening agents into absorbent substrates.

2. Description of the Prior Art

For various beneficial reasons, the practice has recently developed of softening and otherwise conditioning household apparel and fabrics during drying after laundering. Fabric conditioning products comprising sheet goods (substrate) coated or impregnated with a fabric-softening chemical or other fabric conditioning chemicals have been commingled with damp laundry during the drying of the laundry at the elevated temperatures encountered in a typical household laundry dryer. At the elevated temperature, the fabric conditioning chemicals are released from the product and transferred to the commingled fabrics during drying.

Typical absorbent sheet goods employed as a substrate for heat-activated, fabric-softening products include flexible foam, felted, non-woven, and wet-lay fibrous sheets such as paper toweling, scrims, cloth, and air-lay webs containing cellulosic or synthetic fibers of papermaking-length or longer. For example see U.S. Pat. No. 3,442,692 entitled Method of Conditioning Fabrics.

Fabric-softening chemicals and other specialized chemicals for conditioning fabrics have been coated onto thin substrates. Preferably, to avoid staining and other problems during drying, the conditioning chemicals have been impregnated into absorbent substrate in combination with controlling the absorbent characteristics of the substrate. For example see U.S. Pat. No. 3,686,025 entitled Textile Softening Agents Impregnated into Absorbent Materials.

Impregnating absorbent substrates with liquid fabric conditioning agents was previously accomplished by applying excess liquid to the substrate followed by squeezing off excess liquid with rollers forming a compression nip. A typical disclosure of the technique of applying excess liquid to the absorbent substrate followed by squeezing off the excess with rollers is contained in U.S. Pat. No. 3,686,025 from column 14, line 68 to column 15, line 44.

British Pat. No. 1,419,647 discloses another method of impregnating an absorbent substrate with one roller. Substantial compression of the substrate is avoided (see page 5, lines 30 to 35).

Applying a discrete surface coating to a paper type web is disclosed in U.S. Pat. No. 3,895,128. However, impregnating a web is not taught (see column 7, line 47 to column 8, line 23).

Fabric conditioner chemicals are usually applied in liquid form (a molten bath) to the absorbent substrate and then solidified by cooling.

A particularly suitable method for coating or impregnating liquid fabric conditioning chemicals into a substrate is by passing the substrate through a compressive nip formed by two rollers while the liquid is applied to the lower roller and doctored to a controlled film on the roller which film enters the nip along with the substrate where impregnation occurs during compression of the substrate in the nip.

SUMMARY OF THE INVENTION

In the process of applying liquid to a substrate by compressing the substrate in a nip while in the presence of a controlled quantity of the liquid obtained by applying the liquid to the lower roller of the nip and controlling quantity of the liquid with a doctor located before the nip and cooperating with the lower roller; the improvement which comprises applying an excess quantity of the liquid as a film on the lower roller, cutting the liquid film on the lower roller, removing the excess liquid from the roller and retaining a controlled quantity of liquid on the lower roller as it enters the nip with the substrate.

An apparatus is provided for applying a liquid to a substrate comprising:

- a first rotatable cylinder;
- a second rotatable cylinder positioned below the first cylinder to form a nip between the first cylinder and the second cylinder;
- means for feeding the absorbent substrate to the nip;
- means for applying a quantity of the liquid onto said second cylinder said quantity including an excess portion;
- a tension wire doctor cooperating with said second cylinder to remove said excess portion from the second cylinder and to doctor a film of the liquid on the lower cylinder at a point in the direction of rotation of the lower cylinder which point is both before the nip and after the point of application of the liquid onto the lower cylinder; and
- means for removing said substrate from said nip.

DETAILED DESCRIPTION OF THE INVENTION AND PREFERRED EMBODIMENT

Figure 1:
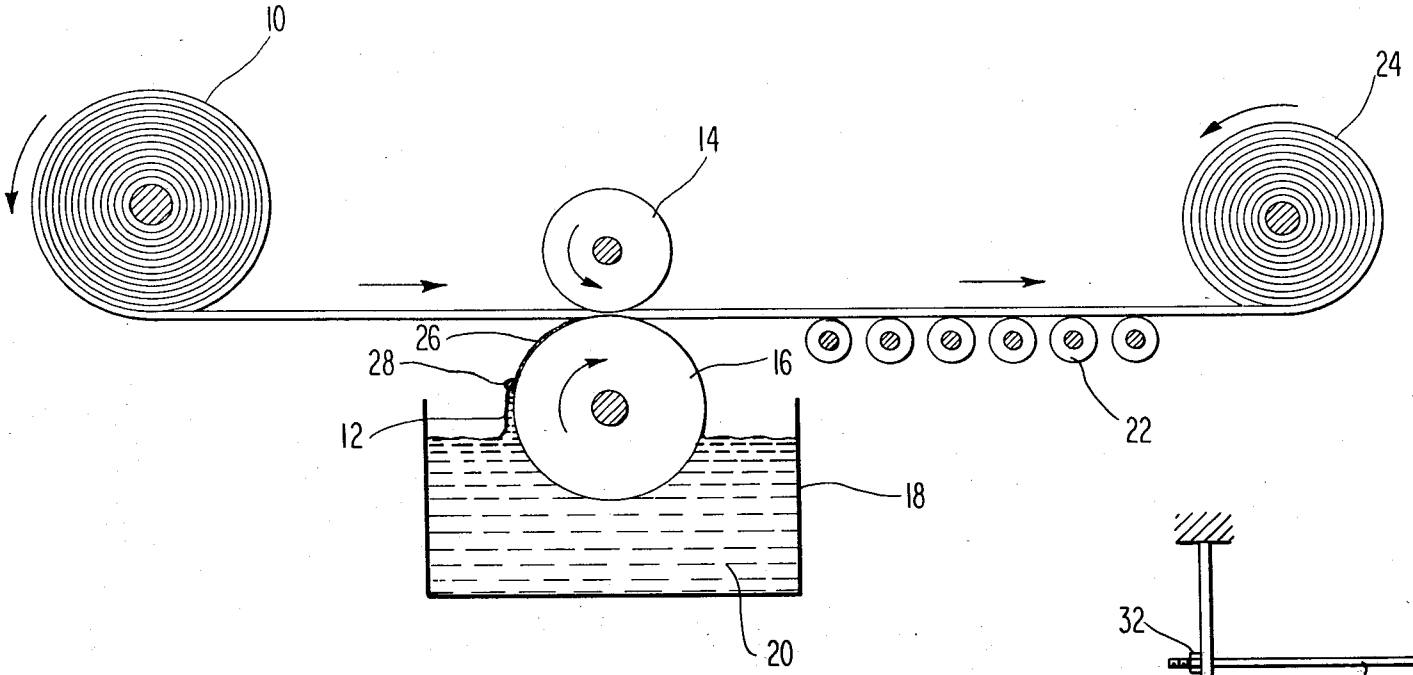
FIG. 1 depicts the manufacture of a heat activatable, fabric conditioning product with a tension wire cutting the liquid to control the volume of liquid supplied to a nip during compression of the absorbent substrate.

Absorbent substrates suitable for use in the process provided by the present invention should have a thickness of at least about 0.05 centimeters and substantial "free space" or "void volume". Examples of suitable absorbent substrates are sponges, flexible foams, non-woven fabrics such as multi-ply paper, high bulk paper, felted fabrics and knitted or woven bulky fabrics.

The free space of substrates can be defined in terms of the absorbent capacity determined according to a standard test. A test for determining absorbent capacity of thick paper, foam or cloth substrates is U.S. Federal Specifications UU-T-595b modified as follows:

(1) tap water is used instead of distilled water;
(2) the specimen is immersed for 30 seconds instead of 3 minutes;
(3) draining time is 15 seconds instead of 1 minute; and
(4) the specimen is immediately weighted on a balance scale having a pan with turned-up edges.

High bulk, low density paper products (having a basis weight of greater than about 100 pounds per 3,000 sq. ft. and a thickness greater than about 1/16 inch) have an absorbent capacity value as determined by the above test of greater than about 6.0 and are suitable for use in the present invention.

Absorbent substrates impregnated with a heat-softenable, fabric-conditioner are well known and will be referred to hereinafter as heat-activatable fabric conditioning products and also as "impregnated substrate".

One or more fabric conditioning chemicals may be used and may be mixed with other optional additives such as anti-static agents and perfumes. Usually, the amount of fabric conditioning chemical impregnated into the substrate will be from about 0.023 to about 0.123 grams per cubic centimeter of unimpregnated substrate.

The substrate is usually in the form of a long, wide sheet having a thickness of about 0.05 centimeters or thicker with a thickness of about 0.25 centimeters preferred.

The preferred substrate is flexible foam sheet material having a void volume of greater than about 80% (preferably greater than about 95%) and a thickness of greater than about 0.05 centimeters. A void volume of greater than about 80% correlates approximately with an absorbent capacity value as determined by the above test of greater than about 10.

Void volume is expressed as a percentage of the total volume and is equal to the apparent total volume of the substrate less the volume of the substrate material. For substrates having high void volumes of greater than 80%, such as polyurethane foam, the apparent volume is readily determined by cutting the foam into a convenient shape such as a cube for which the volume is easily calculated. The volume of the polyurethane material comprising the foam can be calculated by weighing the foam cube and calculating the volume based upon the density of the polyurethane. The difference between the volume of the uncompressed cube and the volume of the polyurethane equals the void volume. Alternatively, the volume of the polyurethane material could be determined by displacement in which the volume of a liquid is measured before and after the foam cube is submerged into the liquid and any entrapped air is expelled (squeezed out).

Preferred foam sheet material is flexible, polyether-based, polyurethane foam having a thickness of about 0.25 centimeters and a pore size in the range of from about 10 pores per inch to about 100 pores per inch. High porosity foam is particularly preferred. While woven, nonwoven or knitted cloth fabrics are suitable, they are not preferred in practicing the present invention.

Heat-activatable fabric conditioning products are produced by impregnating a suitable substrate with a liquid fabric conditioning composition followed by solidifying the composition in the substrate. Impregnation is accomplished by contacting the substrate with the liquid fabric conditioning composition, squeezing the substrate in the presence of the liquid and allowing the substrate to expand while still in the presence of the liquid. Preferably the fabric conditioner is liquified by being held at an elevated temperature above the melting point. Solvents can be used to lower the melting point and viscosity of the fabric conditioner chemical.

With the hot-melt technique, the impregnated substrate is cooled to solidify the fabric conditioning composition after impregnation. The present invention is particularly suitable for impregnating with liquids having a high viscosity.

Fabric conditioning chemicals and mixtures thereof suitable for use in heat-activatable fabric conditioning products are well known and disclosed in U.S. Pat. No. 3,442,692 issued to C. J. Gaiser on May 6, 1969, entitled Method of Conditioning Fabrics at column 3, line 7 to column 4, line 24 which disclosure is incorporated herein by reference with respect to its teachings of suitable fabric conditioning chemical compositions. U.S. Pat. No. 3,632,396 issued on Jan. 4, 1972 entitled Dryer-added Fabric-Softening Composition discloses suitable heat-activated fabric softening compositions at column 7, line 70 to column 12, line 73 which disclosure is also incorporated herein by reference with respect to its teachings of heat-activatable fabric softening and conditioning chemicals. Suitable compositions are also disclosed in U.S. Pat. Nos. 3,686,025; 3,870,145 and 3,895,128. Usually, from about 2 to about 10 ounces of active ingredients (fabric conditioner chemical) are impregnated per square yard of substrate with about 4 ozs. per square yard being preferred.

The process of the present invention for producing a heat-activated fabric conditioning product can be best understood with reference to the drawing. Suitable absorbent substrate, 10, passes through the nip of mating rollers 14 and 16 where it is compressed in the presence of fabric conditioning composition, 26, which causes impregnation of the liquid (usually molten) fabric conditioning composition into the substrate 10. The film 26 is a portion of film 12 and is composed of one or more heat-activatable fabric conditioner chemicals along with any other additives if desired, such as perfumes or solvents. Film 26 is supplied to the nip by lower roller 16. Film 12 is applied to roller 16 by it rotating while partially immersed in a molten bath 20, contained in heated tank 18. Tension doctor wire 28 controls the volume of liquid 26 supplied to the nip by lower roller 16 by cutting film 12. An excess portion of film 12 is continuously returned to bath 20. The impregnated substrate expands as it leaves the nip formed by rollers 14 and 16 which completes the impregnating process. The impregnated product passes over rollers 22 where solidification of the impregnant occurs as the impregnated substrate cools to ambient temperature. Preferably, rollers 14 and 16 are both driven to rotate at the same peripheral speed.

The improvement provided by the present invention in the above process concerns the tension wire doctor as a means for limiting the volume of liquid 12, supplied to the nip by cutting film 12.

In FIG. 1, control of the volume of liquid supplied to the nip is accomplished with a tension doctor blade 28 that restricts the quantity of fluid retained on the surface of lower roller 16 by doctoring a film 26 of the liquid passing under the wire. The thickness of the film is determined by the gap between the tension wire and the lower roller.

In practice, it is preferred to set the tension wire doctor slightly below the horizontal and at a predetermined gap to restrict the volume of liquid 26 being supplied to the nip and then adjust the nip gap during operation of the process usually by lowering the upper roller 14 to the point of incipient frothing. Incipient frothing indicates that the volume of liquid supplied to the nip approximately equals the void volume of the substrate when compressed in the nip.

The apparatus can be understood best by referring to the figures. FIG. 1 shows a roll 10 of substrate being unwound which is the means for supplying substrate to the nip formed by upper cylindrical roller 14 and lower cylindrical roller 16. A similar roll of substrate 24 is wound up as the means for removing substrate from the nip. The means for applying liquid is shown as lower roller 16 rotating while partially immersed in a reservoir 18 containing liquid 20. A portion of the liquid 20 is picked up on the surface of roller 16. Wire 28 is stretched parallel to the cylindrical surface of roller 16 with a slight gap between the roller and the wire. The gap determines the thickness of the film 26 of liquid that enters the nip. Because the volume of film 26 is less than the volume of portion 12 a discrete quantity of liquid returns to bath 18 either as an outer component of film 12 or as a distinct film. The stretching of the wire holds the wire under tension which imparts dimensional stability to the wire.

Figure 2:
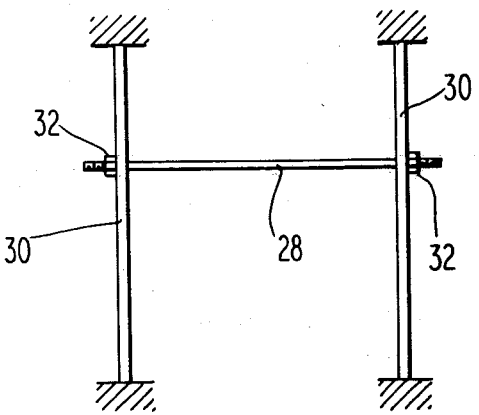
FIG. 2 shows the tension wire doctor.

FIG. 2 shows the tensioning of the wire 28 being accomplished by drawing the wire taut between rigid plates 30. The wire 28 is shown with threaded ends having nuts 32 which are tightened against plates 30 to impart tension forces to wire 28. Many equivalent means are available for holding wire 28 in tension. Preferably, the tension wire doctor has means for adjusting the tension on the wire (adjusting nuts 32 will function as such a tension adjustment means) and means for adjusting the gap between the wire and the cylindrical surface of the lower roller. The wire is drawn essentially straight and parallel to the cylindrical surface of roller 16. Preferably the wire is mounted slightly below a horizontal plane passing through the center of the lower roller in order to cause separation of 12 into two distinct films in addition to film 26.

The film 12 is actually cut by the thin tension wire and a portion of the liquid in film 12 returns to the bath 20. At peripheral speeds of lower roller 16 of about 60 ft./minute or higher, the film 12 is severed or cut into two distinct films in addition to the upper film 26 which passes under the tension wire. This occurs when the tension wire is located below a horizontal line passing through the center of the lower roller. The outer distinct film component of film 12 (not shown) cascades back to the bath 20 like a water fall while the inner distinct film component of film 12 is retained on the roller and accordingly is moving in a direction away from bath 20. The speed at which this occurs is influenced by temperature and alcohol content of the bath.

The liquid fabric conditioning chemicals are preferably kept hot in order to maintain them as a liquid. Hot liquid, as the term is used herein, refers to liquid having a temperature at least about 20° F. higher than ambient. Usually the hot liquid has a temperature of about 122° F. (50° C.) or higher.

Conventional doctor blades are very rigid or supported across the length of the blade. This causes substantial problems when the hot liquid contacts the blade and causes dimensional changes in the doctor or a change in the gap between the roller and the doctor due to expansion. However, the unsupported portion of the wire doctor of the present invention has dimensional stability because the shape of the wire is determined by the tension which draws the wire essentially straight between supports. Usually the lower roller is rotated so that hot fluid 12 contacts the wire and heats it to about the temperature of bath 20, then tension is applied to the wire to almost the yield point before substrate is fed to the nip. When such a procedure is used the tension should be released from the wire before it is allowed to cool when the process is stopped for any reason. If tension is not relieved the yield point of the wire could be exceeded and the wire must be replaced before starting up the process.

A tension wire doctor as the term is used herein refers to a wire having a thin cross section (e.g., from about 0.02 inches to about 0.32 inches). Because of the thin cross section, the wire is not self supporting in an essentially horizontal position between doctor supports unless placed under tension. The tension must be sufficient to draw the wire to a substantially horizontal line between doctor supports at the temperature of the liquid and insufficient to exceed the elastic limit of the wire material (yield point). Without the tension force the wire would sag substantially between supports.

The wire can be made out of any suitable strong material such as metal, glass, or plastic, which is capable of being extruded, drawn or otherwise fabricated into a wire. The cross-sectional shape of the wire is preferably circular although other shapes are suitable, e.g., elliptical or square. The wire is preferably solid, round, drawn stainless steel having a diameter of about 0.125 inches.

The main advantage of the tension wire doctor is the ability to doctor a smooth film of liquid having a precisely controlled thickness despite a temperature for the liquid 12 that deviates from ambient by 20° F. or more. A present gap between the tension wire doctor and the cylinder is held very precisely by the tension wire and deformation of the wire is minimized because of its low mass and cutting action.

Preferably, the tension level on the wire is adjustable and the wire is preferably mounted so that the gap between the wire and the lower cylinder is adjustable within the range of from about 0.005 inches to about 0.01 inches.

The nip gap (minimum distance between rollers 14 and 16) is preferably adjustable and less than the thickness of the substrate.

The present invention is demonstrated by the following example. All proportions are by weight unless indicated otherwise.

EXAMPLE

A fine cell (approximately 80 pores per inch), flexible, polyether based, polyurethane foam having a density of about 1.4 pounds per cubic foot and a thickness of about 0.085 inches was impregnated with a hot liquid fabric conditioning composition comprising 84.8% by weight of a dialkyl dimethyl quarternary fabric softening agent (dihydrogenated-tallow dimethyl ammonium methyl sulfate having a melting point of 138° C. and a molecular weight of about 645) and 15.2% by weight of a nonionic fabric conditioning agent (nonionic modified glyceryl monosterate having an HLB value of about 8.4). The blend employed in this example was diluted with about 6% isopropanol and had a melting point of about 50° C. The process shown in the Figure was used for impregnating the foam with the hot liquid fabric conditioning agents except that wire 28 was below the horizontal line which passes through the center of roller 16.

The liquid in reservoir 20 was held at a temperature of 185° F. and soon after startup of roller 16 the temperature of the wire 20 went from ambient to about the temperature of the liquid. Plates, equivalent to plates 30 and nuts 32 were then adjusted to apply sufficient tension to wire 30 so that the wire was essentially straight and essentially horizontal. The substrate was then fed to the nip. The amount of liquid fed to the nip simultaneously with the absorbent substrate was determined by the space between the tension wire doctor blade 28 and lower roller 16 which was preset at about 0.007 inches. The nip gap was 0.011 inches and the uncompressed void volume of the foam was 98% of the total volume of the foam. Samples of impregnated foam were analyzed and indicated uniform impregnation across the width of the foam (perpendicular to FIG. 1). Furthermore, the amount of liquid impregnated into the foam remained reasonably constant after start up of the process. At a speed of about 60 ft./minute for the substrate (also the peripheral speed of roller 16) the film of liquid 12 on roller 16 was severed by wire 28 with a portion cascading back to bath 20 as a distinct film separate from the portion on the roller 16.

I claim:

1. An apparatus for applying a liquid to a substrate comprising:

a first rotatable cylinder;

a second rotatable cylinder positioned below the first cylinder to form a nip between the first cylinder and the second cylinder;

means for feeding the substrate to the nip;

means for applying a quantity of the liquid onto said lower cylinder said quantity including an excess portion;

a tension wire doctor cooperating with the second cylinder for forming a film of the liquid on the second cylinder and for removing said excess portion from said second cylinder; and means for removing said substrate from said nip.

2. The apparatus of claim 1, wherein said tension wire doctor comprises a wire having a diameter of from about 0.02 inches to about 0.32 inches, means for applying tension to said wire, mounting means for said wire to position the wire parallel to the surface of the lower cylinder with a gap between the wire and the surface of the lower cylinder.

3. The apparatus of claim 2, wherein said wire has a diameter of about 0.125 inches.

4. The apparatus of claim 2, wherein the gap between the wire and the surface of the lower cylinder is from about 0.005 inches to about 0.01 inches.

5. The apparatus of claim 2, wherein said mounting means positions said wire below an essentially horizontal plane passing through the center of said lower cylinder.

6. The apparatus of claim 5, wherein said means for applying the liquid to the lower cylinder comprises a reservoir containing the liquid with the lower cylinder partially immersed in the liquid and said mounting means positions said doctor wire with respect to the lower cylinder in the direction of rotation of the lower cylinder before the nip and after the portion of the lower cylinder that is immersed in the reservoir.

* * * * *